United States Patent [19]

Smith et al.

[11] Patent Number: 4,570,291

[45] Date of Patent: Feb. 18, 1986

[54] COVER FOR BUTT-HINGES

[76] Inventors: Gilbert C. Smith, P.O. Box 13484, Phoenix, Ariz. 85002; Bruce J. Cann, 505 W. Baseline Rd., Tempe, Ariz. 85282

[21] Appl. No.: 631,246

[22] Filed: Jul. 16, 1984

[51] Int. Cl.[4] ..... E05D 11/00

[52] U.S. Cl. ..... 16/250; 16/DIG. 40; 403/23; 403/228

[58] Field of Search ..... 16/250, 251, DIG. 40; 403/23, 228

[56] References Cited

U.S. PATENT DOCUMENTS 2,047,909 7/1936 North ..... 16/250

2,242,421 5/1941 Dodge ..... 16/250 X 2,342,453 2/1944 Colucci ..... 16/250

*Primary Examiner*—Fred Silverberg

*Attorney, Agent, or Firm*—Herbert E. Haynes, Jr.

[57] ABSTRACT

A decorative cover for mounting on butt-hinges to conceal the exposed portions thereof to improve the aesthetic appearance. The cover includes flap portions which are attached to the leaf members of the hinge to place an arcuate in cross section hump portion of the cover in overlaying relationship with the knuckles of the hinge. The decorative hinge cover is formed of an elastomeric material to allow it to conformingly move with the hinge.

21 Claims, 11 Drawing Figures

FIG. 6
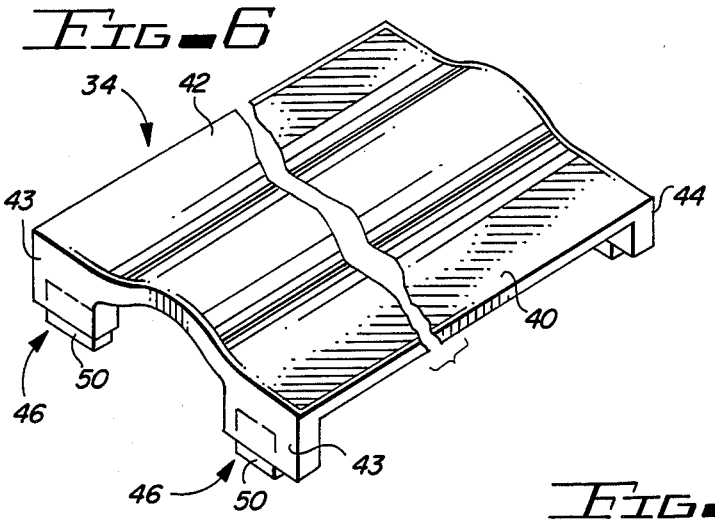
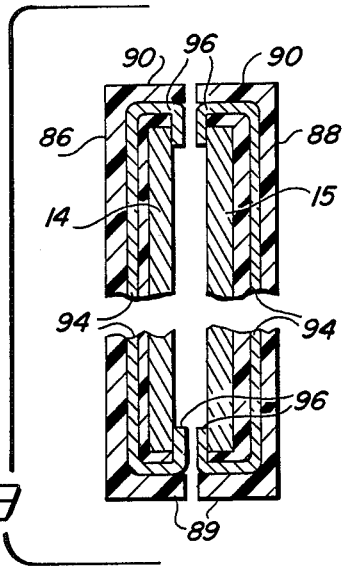
FIG. 9
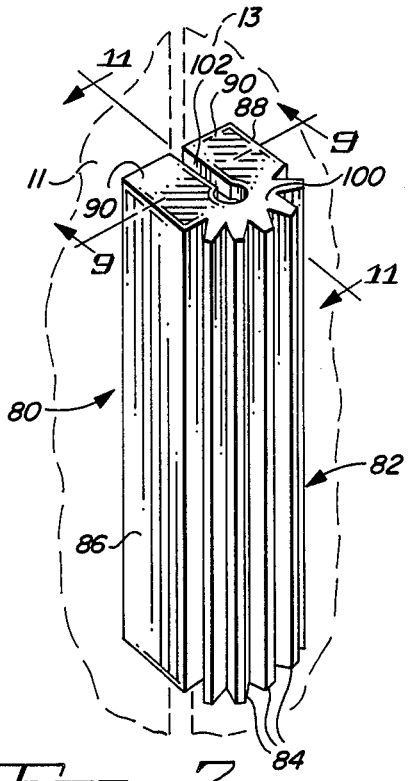
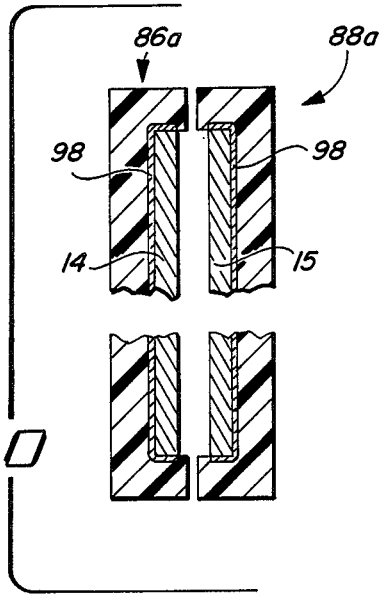
FIG. 10
FIG. 7
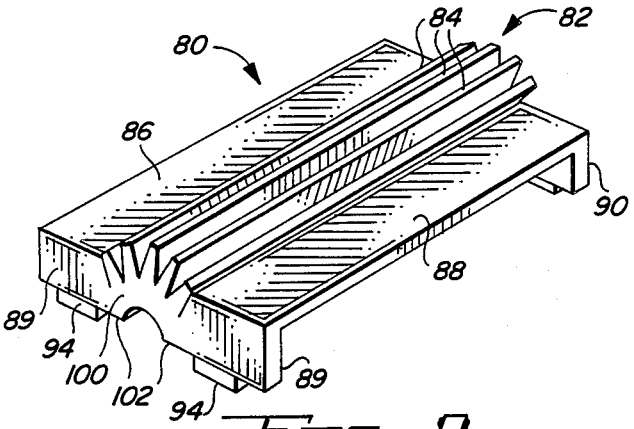
FIG. 8
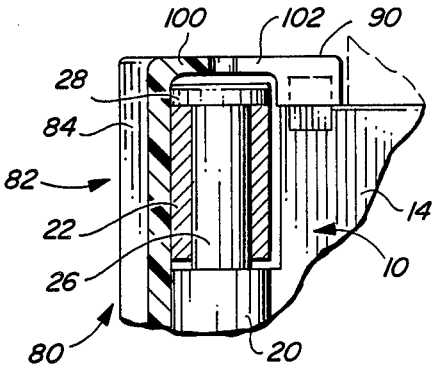
FIG. 11

COVER FOR BUTT-HINGES

BACKGROUND OF THE INVENTION

1. Field of the Invention

The present invention relates in general to door hinges and more particularly to covers for butt-hinges.

2. Description of the Prior Art

As is well known, a butt-hinge is a type of hinge structure which is commonly used in the mounting of swinging doors in openings provided in buildings, rooms, storage cabinets, and the like. A butt-hinge includes a pair of flat plates, commonly referred to as leaves, which are mortized so that one leaf is flush with the edge of the door and the other is flush with the door's casing. The leaves are usually attached to the door and to the casing by screws. The leaves have tubular knuckles formed in spaced increments on their adjacent edges, and the knuckles are alternately arranged along a pivot axis. A pintle, or pivot pin, is axially disposed in the bores of the aligned knuckles to hold the leaves together and form the pivot axis of the hinge.

The aesthetic appearance of butt-hinges leaves something to be desired and very often will detract from the overall decorative appearance of an otherwise well decorated room. Painting the hinges is not a satisfactory answer to the aesthetic problems in that the movements of the knuckles relative to each other will chip or otherwise damage the paint with the end result being worse than an unpainted hinge. Due to this, most people do not attempt to change the finish appearance of butt-hinges which is usually a brass finish. In addition to the brass finish, the aesthetics of the alternately arranged knuckles themselves are not particularly pleasing to the eye.

In that butt-hinges are pivotably movable mechanisms, some form of lubrication is necessary for smooth and silent operation. Sometimes powdered graphite is used as the hinge lubricating substance and sometimes a liquid lubricant, or oil is employed for this purpose. However, the lubricant will in most cases, be extruded from between the abutting ends of the adjacent knuckles and between the knuckles and the head of the pintle as a result of the pivot action. Lubricant extrusion will present an oily film on the knuckles of the hinge to which dirt and dust adhere, and in some cases where excessive lubricant is applied, the extruded lubricants can run, drip or otherwise flow onto the leaves of the hinge and/or onto the adjacent areas of the door and casing. For this reason, many people avoid applying any lubrication whatsoever to the door hinges and make the decision that they would rather have noisy and roughly operating hinges than ones which are messy as a result of lubrication.

In U.S. Pat. No. 158,273, issued on Dec. 29, 1874, to H. T. Blake, and U.S. Pat. No. 196,419, issued on Oct. 23, 1877, to the same inventor, the use of decorative plates on the cofacing surfaces of the leaves of the hinge was suggested. The purpose for the plates was to cover the screw heads used to attach the leaves to the door and to the casing. These plates could not be seen when the door was closed and, of course, did nothing to cover the unsightly knuckles of the hinge.

In prior art U.S. Pat. No. 2,342,453, it was suggested that an arcuate in cross section shield, preferably of sheet metal, be placed in coextending relationship on the knuckles of the hinge. This cover is held in place by springs which wrap around the heads of the pintle in one embodiment and by friction tabs which are disposed between the leaves in another embodiment. In a third embodiment, it is suggested that the cover having the same arcuate cross section be formed of a resilient rubber-like material with integral caps that are forced onto the heads of the pintle to hold the cover in place. The arcuate cross section of these covers is somewhat greater than 180° which, of course, means that less than all of the knuckles are covered when the door is closed and that the leaves of the hinge are not covered at all. The biggest problem, however, results from the longitudinal edges of the cover being disposed so as to engage the leaves of the hinge when the door is opened. When the door is opened, the cover will be deflected away from the knuckles of the hinge by the leaves of the hinge. The deflection is not excessive when the door is part way open so that the leaves of the hinge are at approximately a right angle with respect to each other. When the door is further opened which increases the included angular relationship of the leaves of the hinge, up to and including a 180° relationship, the cover deflection becomes excessive. In the case of the metal hinge cover, the excessive forces applied to one, or both of the longitudinal edges of the cover could cause permanent distortion of the cover and could cause it to pop off of the hinge. In the case of the resilient rubber-like cover, the deflection forces will pucker or otherwise distort the cover, which could even tear it away from the integral caps which hold it in place on the hinge.

SUMMARY OF THE INVENTION

In accordance with the present invention, new and improved covers for butt-hinges are disclosed which completely cover the portions of the hinge which are exposed when a door carried by such hinges is closed. The covers, which may be formed of various colors, improve the aesthetics of the hinge and conceal the mess associated with the lubricating substances used thereon.

The butt-hinge covers of the present invention include a cover body which is formed of an elastomeric material, such as any of the well known suitable synthetic resins, rubber, or the like.

In a first embodiment of the present invention, the cover body is molded or otherwise formed so that in the normal state, i.e., not mounted on a hinge, the body will be of substantially rectangular configuration and will be planar, or nearly so. The body has a length dimension which is approximately equal to the length dimension of the hinge. The body is especially configured to have an arcuate in cross section hump extending longitudinally thereof with a pair of flap portions extending substantially oppositely from the longitudinal edges of the arcuate hump. In this relaxed state, the arcuate hump is less than 180° in cross section, and each of the flap portions are provided with means for attaching the covers to the butt-hinge.

The cover body is mounted by attaching the flaps to the portions of the oppositely facing surfaces of the hinge leaves which extend from the door and casing when the door is closed.

When the door is wide open, i.e., the hinge leaves are at approximately a 180° relationship with respect to each other, the hinge cover will be in its normal, or relaxed state. In that the arcuate hump is provided with a cross section of less than 180° in the relaxed state, it will not be puckered or otherwise distorted when the door is open, as was the case in the hereinbefore discussed prior art structure, and will be disposed in closed covering conformity with the knuckles of the hinge.

When the door is moved to the closed position, the flap of the hinge cover which is attached to the movable hinge leaf will move with that leaf. This will cause the arcuate hump portion to be stretched in wrapped around engagement with the knuckles of the hinge. When the door is fully closed, the hump portion will be stretched to approximately 180° and the flaps will coextend tangentially in substantially parallel relationship from diametrically opposed sides of the stretched hump portion. When the hump portion is stretched in this manner, it will be held taut and thus will present a smooth undistorted shape.

In the above described embodiment, the hinge cover further includes cap means for covering the heads of the pintle. The cap means are separate from the cover body and are axially placed on the pintle heads and have axially extending split skirt portions which are received in the ends of the hump portion of the cover body. In this manner, the cover body and the caps appear to be integral and yet they are free to move relative to each other during opening and closing of the door. This type of freedom of movement is needed in that in some butt-hinges, the pintle will rotate when the door is being opened and closed, and in other hinges, the pintle will remain stationary. This is due to manufacturing tolerances, foreign matter in the bore of the knuckles, amount of lubrication, and the like.

In a second embodiment of the hinge cover of the present invention, the cover body, which is preferably formed of the same elastomeric material as described above with regard to the first embodiment, and is of the same generally rectangular shape with the flap portions on opposite sides of the arcuate hump. The arcuate hump of the cover body is longitudinally fluted to allow the arcuate hump to expand and contract with door movements rather than the stretching action which takes place in the hereinbefore described first embodiment. In the contracted state, i.e., door fully open, the fluted arcuate hump will have a cross section of less than 180°, and when expanded, it will be approximately semicircular. Therefore, the end result of the functioning of these two embodiments of the present invention are the same, but the manner of arriving at the end result is different.

The cover body of the second embodiment is formed with integral pintle head covering flange portions on its opposite ends. The pintle head covering portions are sized so that the heads of the pintles are loosely received therein so that rotational movements, or lack of this movement, will occur within the loosely fitting pintle head covering portions and will not effect the hinge cover in any manner.

Accordingly, it is an object of the present invention to provide new and improved covers for butt-hinges.

Another object of the present invention is to provide new and improved hinge covers which improve the aesthetic appearance of butt-hinges and conceal the mess associated with the lubricating substances used thereon.

Another object of the present invention is to provide new and improved hinge covers which totally cover the portions of the butt-hinges which extend from the doors and casings upon which the butt-hinges are mounted.

Another object of the present invention is to provide new and improved hinge covers which are in a relaxed normal hinge covering state when the hinge leaves are at an approximately 180° relationship with respect to each other and are in a stretched hinge covering state when the hinge leaves are in a coextending substantially juxtaposed relationship with respect to each other.

Another object of the present invention is to provide new and improved hinge covers which are in a relaxed normal hinge covering state when the hinge leaves are at an approximate 180° relationship with each other and are in an expanded hinge covering state when the hinge leaves are in a coextending substantially juxtaposed relationship with respect to each other.

Another object of the present invention is to provide new and improved hinge covers of the above described character which includes a substantially rectangular hinge cover body with an arcuate hump means extending longitudinally thereof between a pair of flaps.

Another object of the present invention is to provide new and improved hinge covers of the above described character wherein the arcuate hump portion is configured to cover the knuckle portion of the butt-hinge and has a cross section of less than 180° when the hinge cover is in the relaxed normal state and will have a cross section of approximately 180° when the hinge cover is in the stretched, or expanded taut state.

Yet another object of the present invention is to provide new and improved hinge covers of the above described type wherein the flaps are provided with means for attachment to the extending portions of the oppositely facing surfaces of the leaves of the butt-hinge.

Still another object of the present invention is to provide new and improved hinge covers of the above described type which further includes means for covering the heads of the pintle of the hinge.

The foregoing and other objects of the present invention as well as the invention itself, may be more fully understood from the following description when read in conjunction with the accompanying drawings.

BRIEF DESCRIPTION OF THE DRAWINGS

FIG. 6 is a perspective view of the hinge cover body illustrating the relaxed normal state thereof.

FIG. 7 is a perspective view of a second embodiment of the hinge cover of the present invention with the hinge cover shown as being mounted on a butt-hinge.

FIG. 8 is a perspective view of the hinge cover of this second embodiment showing the relaxed normal state thereof.

FIG. 9 is an enlarged fragmentary sectional view taken along the line 9—9 of FIG. 7.

FIG. 10 is a sectional view similar to FIG. 9 and showing a modification thereof.

FIG. 11 is an enlarged fragmentary sectional view taken along the line 11—11 OF FIG. 7.

DESCRIPTION OF THE PREFERRED EMBODIMENTS

Figure 1:
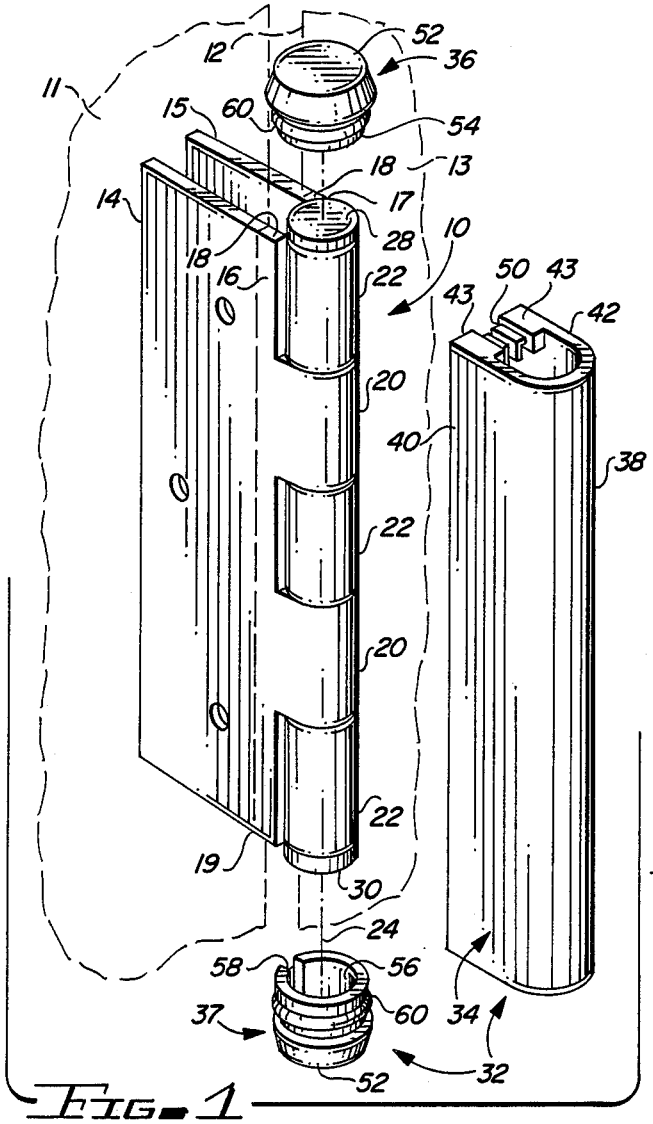
FIG. 1 is a perspective view of a typical butt-hinge with a first embodiment of the hinge cover of the present invention being shown in exploded relationship thereto.

Referring more particularly to the drawings, FIG. 1 shows a typical butt-hinge 10 which is mounted in the usual mortized fashion in the casing 11 and the edge 12 of a swinging door 13, with the casing 11 and the door 13 being shown in dashed lines in FIG. 1. As is well known in the art, the butt-hinge 10 includes a pair of hinge leaves, or plates, 14 and 15 having suitable holes therein by which they are attached to the casing 11 and door 13, respectively, by screws (not shown). When mounted in the usual manner, the hinge leaves 14 and 15 will extend laterally from between the casing and the door, and those extending portions of the leaves are identified by the reference numerals 16 and 17, respectively. The extending leaves each have an exposed upper end edge 18 and an exposed lower end edge 19, as seen best in FIGS. 3 and 4. The hinge leaf 14 is provided with tubular knuckles 20 and the hinge leaf 15 is provided with tubular knuckles 22. These tubular knuckles 20 and 22 are alternately arranged along a pivot axis 24 and a hinge pin, or pintle 26 is disposed in the bore 27 defined by the knuckles. The pintle 26 is integrally provided with an enlarged head 28 on its upper end and a dummy head 30 is provided on the lower end of the knuckle bore 27. The dummy head is not connected to the pintle 26 but is fixedly mounted in the lower end of the knuckle bore 27.

In a first embodiment of the present invention, a hinge cover is provided which is identified in its entirety by the reference numeral 32. As will hereinafter be described in detail, the hinge cover 32 includes a cover body 34 for covering the aligned knuckle portions 20 and 22 of the hinge 10 and the oppositely facing surfaces of the extending portions 16 and 17 of the hinge leaves 14 and 15, and an identical pair of caps 36 and 37 for mounting on the pintle head 28 and the dummy head 30 of the hinge.

The cover body 34 is molded or otherwise formed of an elastomeric material, which may be a suitable synthetic resin, a rubber composition, or the like. As seen in FIG. 6, in the normal, or relaxed state of the cover body 34, i.e., not mounted on the butt-hinge 10, the body is of generally rectangular configuration with an arcuate in cross section hump 38 extending centrally longitudinally thereof with a pair of flaps 40 and 42 extending substantially oppositely from the longitudinal sides of the arcuate hump 38. For reasons which will hereinafter be described in detail, the arcuate hump 38 is configured to form less than 180° in this relaxed state. Each of the flaps 40 and 42 are provided with end flanges 43 and 44, respectively, which extend normally and integrally from the opposite ends of the flaps, and each of the flaps 40 and 42 are provided with means 46 for attaching the hinge cover 32 to the butt-hinge.

When the hinge cover body 34 is mounted on the butt-hinge, in the manner to be described below, the cover 34 will be in the normal, or relaxed position shown in FIG. 6 when the door 13 is fully opened so that the hinge leaves 14 and 15 will be in an approximately 180° relationship with each other. When the door 13 is to be closed, the hinge leaf 15 will be rotated about the hinge axis 24 through approximately 180° so that the two leaves 14 and 15 will coextend from the knuckles 20 and 22 in a substantially juxtaposed relationship. When in the closed door position, the hinge cover body 34 will move to, and be held, in the folded over taut position shown best in FIGS. 1 and 2. In the folded over taut position, the arcuate hump 38 will be stretched from its less than 180° cross sectional configuration to the approximate 180°, or semicircular configuration shown in those figures, and the flaps 40 and 42 will coextend tangentially from the diametrically opposed sides of the stretched arcuate hump.

Figure 3:
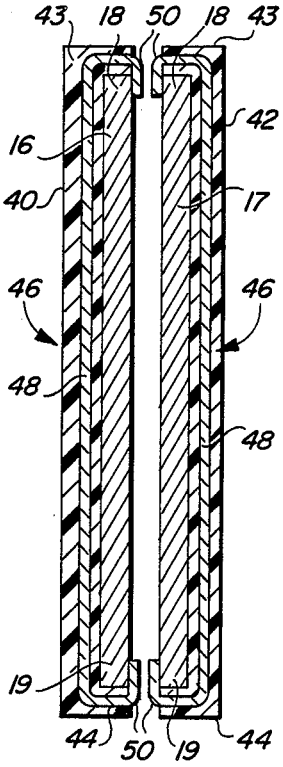
FIG. 3 is an enlarged sectional view taken along the line 3—3 of FIG. 2.

As seen best in FIG. 3, the cover attachment means 46 provided in each of the flaps 40 and 42, is preferably in the form of rigid straps 48, preferably of metal, which are embedded in the flaps 40 and 42 during fabrication of the hinge cover. The rigid straps 48 extend longitudinally of their respective flaps 40 and 42 and are folded back on their opposite ends to provide a hook 50 on each of the opposite ends.

It will be understood that the extending portions 16 and 17 of the hinge leaves 14 and 15 may vary in width from one hinge installation to another as determined by the particular installation techniques and the installing craftsman. Therefore, when the cover body 34 is fabricated, the width dimensions of the flaps 40 and 42 are oversized. When the hinge cover 32 is to be installed, the flaps 40 and 42 thereof are longitudinally trimmed so that the width dimensions thereof will closely match the width dimensions of the extending hinge leaf portions 16 and 17 of the particular hinge upon which the cover is to be installed.

When the flaps 40 and 42 have been sized, as described above, the flap 40 is placed adjacent the hinge leaf 14 with one of the hooks 50, for example the lower one, being looped over the lower edge 19 of the extending leaf portion 16. Then the flap 40 is bent back and stretched slightly to place the upper hook 50 in looped over hooked engagement with the exposed upper edge 18. The arcuate hump portion 38 of the cover 34 is then wrapped around the knuckles 20 and 22 of the hinge 10 and the flap 42 is installed on the other extending hinge leaf portion 17 in the same above described manner.

Therefore, the hinge cover body 34 will be demountably and tightly attached to the butt-hinge 10 by means of the rigid straps 48 which, in addition to the attaching function, will rigidify the flaps 40 and 42 and hold them flat against the opposed surfaces of the extending portions 16 and 17 of the hinge leaves 14 and 15. By mounting the cover body 34 in this manner, the arcuate hump portion 38 will loosely conform and wrap part way around the knuckles 20 and 22 of the hinge 10 when the door 13 is fully open and will be stretched to tightly conform and wrap around a larger portion of the knuckles when the door is closed.

As hereinbefore mentioned, the caps 36 and 37 are identical, therefore, the following description of the cap 36 will be understood to also apply to the other cap 37. The cap 36 includes an enlarged head 52 with a reduced diameter skirt 54 extending axially therefrom. The head 52 and skirt 54 cooperatively define a blind bore 56 which opens axially onto the end of the skirt 54. The skirt 54 is longitudinally split as at 58 and is provided with an annular bead 60 on the periphery thereof.

The caps 36 and 37 have their blind bores 56 sized so as to loosely and axially receive the pintle head 28 and part of the axially adjacent knuckle 22 in the case of the cap 36, and the dummy head 30 and the axially adjacent portion of the knuckle 22 in the case of the cap 37. The loose fit of the caps 36 and 37 relative to the hinge parts received therein allows those hinge parts to move during door opening and closing actions without causing the caps 36 and 37 to move with them.

Figure 5:
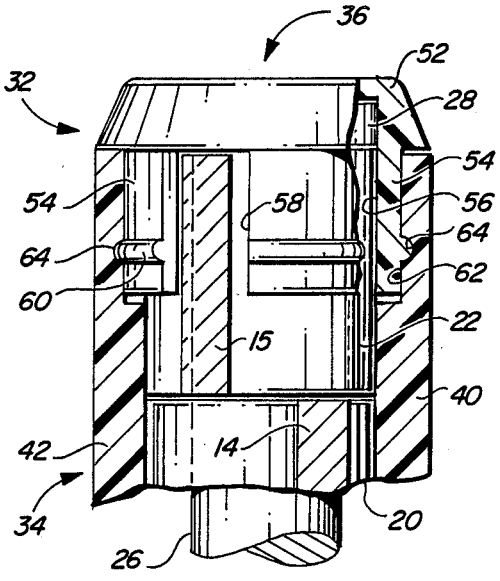
FIG. 5 is an enlarged fragmentary sectional view taken along the line 5—5 of FIG. 2.

As seen best in FIG. 5, the inner concave surface of the arcuate hump 38 of the cover body 34 is relieved at its opposite ends (one shown) to form a counterbore 62 at each of the opposite ends. The counterbores 62 (one shown) are provided to nestingly receive and contain the skirts 54 of the caps when they are axially installed on the heads 28 and 30 of the hinge 10. An annular groove 64 is formed in each of the counterbores 62 for receiving the annular beads 60 of the caps 36 and 37, to provide a frictional engagement means. In this manner, the caps 36 and 37 will be frictionally retained against axial movements which could otherwise occur as a result of pivotal action of the hinge 10.

Figure 2:
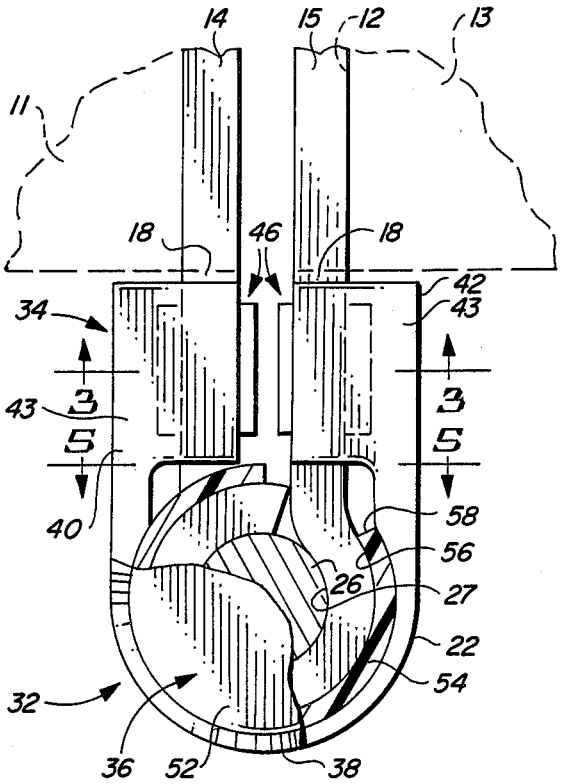
FIG. 2 is an enlarged top view showing the first embodiment of the hinge cover as being mounted on the butt-hinge with the hinge cover being partially broken away to show the various features thereof.

When the caps 36 and 37 are installed, they are aligned so that the splits 58 provided in the skirts 54 thereof are disposed to straddle the tongue-like portions which extend between the knuckles 22 and the hinge leaf 15 as shown in FIGS. 2 and 5.

Figure 4:
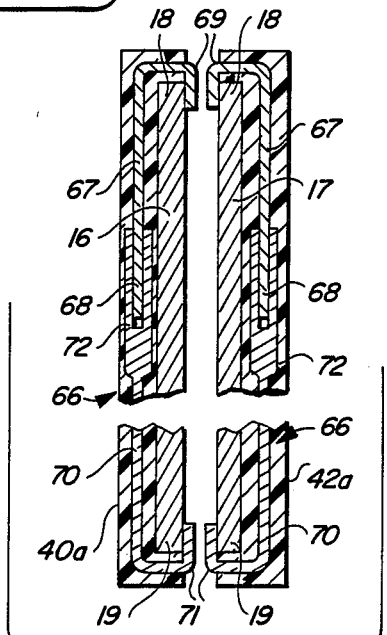
FIG. 4 is a fragmentary view similar to FIG. 3 and showing a modification of the first embodiment of the hinge cover of the present invention.

As is well known in the art, the longitudinal dimensions of hinge leaves 14 and 15 may vary somewhat. Relatively small variations in the longitudinal hinge leaf dimension will not deter the use of the above described hinge cover 32. However, in some instances of relatively large dimensional increases, the cover 32 may not work. The modification shown in FIG. 4 is provided to accomodate relatively large dimensional increases. In this modification, the various above described characteristics and parts of the hinge cover 32 remain the same with the exception of the flaps 40*a* and 42*a* each of which contain a telescopically extensible strap 66 which provides the cover mounting means.

The telescopically extensible straps 66 include a first member 67 having a tongue 68 on one of its ends and a folded back hook 69 on its opposite end. A second member 70 is provided with a hook 71 on one of its ends and a socket member 72 on its other end in which the tongue 68 of the first member 67 is slidably movable. The telescopically extensible straps 66 provide the same type of mounting means as hereinbefore fully described with regard to the hinge cover 32 and, in addition, allow the flap members 40*a* and 42*a* to be stretched longitudinally to accommodate the increased length dimensions of some hinges.

Reference is now made to FIGS. 7 through 11 wherein a second embodiment of the present invention is shown. The hinge cover of this embodiment, which is indicated generally by the reference numeral 80, is a one piece structure which is of generally rectangular configuration in its normal, or relaxed state, i.e., not mounted on the butt-hinge 10 (FIG. 1) or mounted thereon with the door 13 being fully opened. In this relaxed state, the hinge cover 80 is provided with an especially configured arcuate in cross section hump 82, which is less than 180° in the same manner as the previously described hinge cover 32. The hump 82 is longitudinally fluted as at 84 to allow it to expand, as opposed to stretching, from its less than 180° shape in the relaxed state to approximately 180° when in the taut state, i.e., mounted on a hinge with the door closed.

The cover 80 is further provided with a pair of flaps 86 and 88 extending integrally and substantially oppositely from the longitudinal sides of the fluted arcuate hump 82 when the cover 80 is in the relaxed state. Each of the flaps 86 and 88 are formed with end flanges 89 and 90 which cover the exposed edges 18 and 19 (FIG. 1) of the hinge leaves 14 and 15. And, each of the flaps 86 and 88 may be provided with cover mounting means in the form of the rigid straps 94 shown best in FIG. 9. These straps 94 are embedded in their respective flaps 86 and 88 and are provided with hooks 96 on their opposite ends. Thus, the mounting straps 94 are identical, both structurally and functionally, to the hereinbefore described mounting means 46.

A modified mounting means is shown in FIG. 10 wherein flaps 86*a* and 88*a* are affixed to the extending portions of the hinge leaves 14 and 15 by means of a suitable adhesive as indicated at 98.

When the hinge cover 80 is mounted on the butt-hinge, and the door is closed, the cover 80 will be in the folded over taut position shown in FIG. 7. In this position, the fluted arcuate hump 82 is expanded to its approximately 180°, or semi-circular state, and the flaps 86 and 88 will coextend in substantially juxtaposed relationship tangentially from the diametrically opposed sides of the expanded hump 82.

Therefore, even though the expanding action of the hump 82 of the hinge cover 80 is different from the stretching action of the hump 38 of the hinge cover 32, the same objectives are accomplished in both hinge covers in that the knuckle covering humps 38 and 82 of the covers 32 and 80, respectively, will change from less than 180° in the relaxed state to the taut position of approximately 180° when the door is closed.

The fluted arcuate hump 82 of the hinge cover 80 is provided with an integral flange 100 on each of the opposite ends thereof, with the flanges being split as at 102 to allow them to move with the hinge cover 80 from the open position shown in FIG. 8 to the substantially closed position shown in FIG. 7. As seen best in FIG. 11, the flanges 100 (one shown) are configured to partially overlay the heads 28 and 30, (the head 30 not being shown in FIG. 11) of the hinge, to partially cover the heads.

While the principles of the invention have now been made clear in the illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles.

For example, it will be apparent that during fabrication of the hinge covers 32 and 80, coloring pigments can be added to the materials of which the covers are made to provide whatever decorative effects may be desired.

The appended claims are therefore intended to cover and embrace any such modifications within the limits only of the true spirit and scope of the invention.

What I claim is:

1. A cover for and in combination with a butt-hinge of the type having an axis, a pair of leaf members for mounting on a swinging door and a door casing with the leaf members having extending side portions and plural knuckles which are pivotably interconnected by a pintle for movement between a closed position wherein the leaf members are in juxtaposed relationship and an open position wherein the leaf members are in approximately a 180° relationship with each other, said side portions having edge surfaces extending perpendicular to the hinge axis, said cover comprising:

(a) an elongated one piece cover body for mounting on the butt-hinge, said cover body including opposite longitudinal edges extending perpendicular to the hinge axis, said body having an arcuate in cross section hump portion for covering all of the plural knuckles of the butt-hinge, said cover body further including a pair of bendable scraps which extend integrally and outwardly from the opposite longitudinal edges of the hump portion thereof, said straps being about to be in contiguous overlaying engagement with the surfaces of the extending side portions of the leaf members; and (b) said cover body being formed of an elastomeric material and movable with the hinge between a relaxed state wherein said cover body lies in a substantially flat plane when the hinge is in the open position thereof and a taut state wherein said cover body is wrapped around the knuckles of the hinge in a folded configuration when the hinge is in the closed position thereof.

2. A cover for a butt-hinge as claimed in claim 1 wherein the hump portion of said cover body has an arcuate cross section of less than 180° when in the relaxed state.

3. A cover for a butt-hinge as claimed in claim 1 wherein the hump portion of said cover body has an arcuate cross section of less than 180° when in the relaxed state and an arcuate cross section of approximately 180° when in the taut state.

4. A cover for a butt-hinge as claimed in claim 1 wherein the hump portion of said cover body has an arcuate cross section of less than 180° when in the relaxed state and is stretched to approximately 180° when in the taut state.

5. A cover for a butt-hinge as claimed in claim 1 wherein the hump portion of said cover body is longitudinally fluted and has an arcuate cross section of less than 180° when in the relaxed state and is expanded to approximately 180° when in the taut state.

6. A cover for a butt-hinge as claimed in claim 1 and further comprising means for attaching the pair of bendable straps of said cover body to different ones of the edge surfaces of the leaf members of the butt-hinge.

7. A cover for a butt-hinge as claimed in claim 6 wherein said means is an adhesive.

8. A cover for a butt-hinge as claimed in claim 6 wherein said bendable straps includes a pair of rigid straps, each of said pair of rigid straps having a hook on each of its opposite ends for looped over engagement with the edge surfaces of the leaf members of the butt-hinge.

9. A cover for a butt-hinge as claimed in claim 8 wherein each of said pair of rigid straps is longitudinally extensible.

10. A cover for a butt-hinge as claimed in claim 6 wherein each of said pair of bendable straps of said cover body is formed with a normally extending end flange on each of its opposite ends for covering the exposed opposite end edges of the leaf members of the butt-hinge.

11. A cover for a butt-hinge as claimed in claim 1 with the butt-hinge being of the type wherein the pintle has an enlarged head on one end thereof and has a dummy head associated with the knuckles adjacent the opposite end of the pintle, said cover further comprising head covering means for concealing the head of the pintle of the butt-hinge and the dummy head thereof.

12. A cover for a butt-hinge as claimed in claim 11 wherein said head covering means includes a pair of caps for axial placement on different ones of the head of the pintle of the butt-hinge and the dummy head thereof.

13. A cover for a butt-hinge as claimed in claim 11 wherein said head covering means comprises:

(a) a first cap having a head portion with an axially extending split skirt portion of reduced diameter, the head portion and the skirt portion cooperatively defining a blind axial bore for receiving the head of the pintle of the butt-hinge; and (b) a second cap having a head portion with an axially extending split skirt portion of reduced diameter, the head portion and the skirt portion cooperatively defining a blind bore for receiving the dummy head of the butt-hinge.

14. A cover for a butt-hinge as claimed in claim 13 and further comprising:

(a) said arcuate in cross section hump portion of said cover body defining an elongated concave surface which faces the knuckles of the butt-hinge when said cover is mounted thereon; and (b) said arcuate in cross section hump portion of said cover body formed with a counterbore therein at each of the opposite ends of the elongated concave surface thereof for nestingly receiving the split skirt portions of said first and said second caps when said cover body and said first and second caps are mounted on the butt-hinge.

15. A cover for a butt-hinge as claimed in claim 14 and further comprising means formed on the periphery of the split skirt portions of said first and second caps and in the counterbores of said cover body to provide a frictional engagement therebetween.

16. A cover for a butt-hinge as claimed in claim 11 wherein said head covering means comprises a normally extending flange formed integrally on each of the opposite ends of the arcuate in cross section hump portion of said cover body for at least partially overlaying the head of the pintle of the butt-hinge and the dummy head thereof.

17. A cover for and in combination with a butt-hinge comprising:

(a) a butt-hinge having an axis, a pair of leaf members one for mounting on the edge of a door and the other for mounting on the adjacent face of a door casing, said leaf members being mountable so as to extend from between the door and the door casing to provide extending side portions and having a plurality of axially aligned knuckles which are interconnected by a pintle so that said butt-hinge is pivotably movable between a closed position wherein the leaf members are in juxtaposed relationship and an open position wherein the leaf members are in approximately a 180° relationship with respect to each other, said side portions having edge surfaces extending perpendicular to the hinge axis;

(b) an elongated one piece cover body mounted on said butt-hinge and including opposite longitudinal edges extending perpendicular to the hinge axis, said body having an arcuate in cross section hump portion which covers all of the axially aligned knuckles of said butt-hinge and a pair of bendable straps which extending integrally an outwardly from the opposite longitudinal edges of the hump portion thereof, said straps being bent to be in into contiguous overlaying engagement with the oppositely facing surfaces of the extending side portions of the leaf member of said butt-hinge; and (c) said cover body being formed of an elastomeric material for movement with said butt-hinge between a relaxed state wherein said cover body lies in a substantially flat plane when said butt-hinge is in the open position and a taut state wherein said cover body is wrapped around the knuckles of said butt-hinge when said butt-hinge is in the closed position thereof.

18. A cover for a butt-hinge as claimed in claim 17 wherein the hump portion of said cover body has an arcuate cross section of less than 180° when in the relaxed state and an arcuate cross section of approximately 180° when in the taut state.

19. A cover for a butt-hinge as claimed in claim 17 and further comprising means for attaching the pair of bendable straps of said cover body to different ones of the edge surfaces of the leaf members of said butt-hinge.

20. A cover for a butt-hinge as claimed in claim 19 wherein said bendable straps includes a pair of rigid straps, each of said pair of rigid straps having a hook on each of its opposite ends for looped over engagement with the edge surfaces of the leaf members on said butt-hinge.

21. A cover for a butt-hinge as claimed in claim 17 wherein the pintle of said butt-hinge has an enlarged head on one end thereof and has a dummy head associated with the one of the knuckles that is disposed adjacent the opposed end of the pintle, said cover further including head covering means for mounting on the fixed head of said pintle and the dummy head for concealed covering thereof.

* * * * *